US006006900A

United States Patent [19]

Hasten

[11] Patent Number: 6,006,900

[45] Date of Patent: Dec. 28, 1999

[54] MEZUZAH

[76] Inventor: Mark Hasten, 1115 W. 75th St., Indianapolis, Ind. 46260

[21] Appl. No.: 09/087,135

[22] Filed: May 28, 1998

[51] Int. Cl.[6] ..... A45C 11/00

[52] U.S. Cl. ..... 206/19; 206/232; 206/39.8

[58] Field of Search ..... 206/15.2, 15.3, 206/19, 39, 39.8, 232, 361, 362.3, 446; D99/25

[56] References Cited

U.S. PATENT DOCUMENTS

| | | | |
|---|---|---|---|
| D. 79,494 | 9/1929 | Goldberg | D99/25 |
| D. 166,400 | 4/1952 | Lawsky | D99/25 |
| 1,573,663 | 2/1926 | Warren | 206/232 |
| 2,347,681 | 5/1944 | Goudreau | 206/19 |
| 2,514,739 | 7/1950 | Brennan | 206/19 |
| 2,637,438 | 5/1953 | Menz et al. | 206/19 |
| 5,311,985 | 5/1994 | Suida | 206/210 |

*Primary Examiner*—David T. Fidei
*Attorney, Agent, or Firm*—Richard A. Zachar

[57] ABSTRACT

A mezuzah having a base portion which is permanently mountable to a doorway fixture, and having a housing portion with a bore in one of its ends for receiving a scroll bearing Biblical text therein, with the housing member being slidably engageable with the doorway mounted elongated base member. The lower, bore communicating end of the housing member abuts a sealing member of the base member upon engagement of the housing member to the base member to effectively seal the bore in which the scroll is disposed to prevent the scroll from falling out and to shelter the scroll. The scroll may be periodically checked for integrity or replaced by sliding the housing member off of the base member to gain easy access to the bore, with the housing member then slidable back onto the base member to secure the scroll in the housing member. A latch may be provided to selectively prevent slidable disengagement of the housing member from the base member.

17 Claims, 2 Drawing Sheets

MEZUZAH

FIELD OF THE INVENTION

The present invention pertains to mezuzahs and more particularly pertains to mezuzahs which allow for repeated checking as to the condition of a Biblical script-containing scroll.

BACKGROUND OF THE INVENTION

Mezuzahs currently enjoy widespread usage throughout the world by those practicing the Jewish faith. In accordance with Judaic teachings, a small scroll inscribed with Biblical verses (Deuteronomy 6:4–9 & 11:13–21) is placed in a case, and the case is attached to the doorpost of a home to secure the scroll of Biblical verses to the home's doorpost. Such a case containing the Biblical script is referred to as a mezuzah.

In further accordance with Judaic teachings, it is important that the scroll of Biblical verses be maintained intact and in good condition. Hence, it is necessary that the scroll be checked periodically to either confirm its good condition or to replace a deteriorated scroll with a new scroll having intact script. Current mezuzahs suffer the shortcoming that they do not allow easy access to the scroll-containing interior compartment for such checking of the condition of the scroll. Accordingly, there is a need for a mezuzah which provides good aesthetic appearance, while providing for easy access to the scroll disposed in the mezuzah.

SUMMARY OF THE INVENTION

In accordance with the present invention, a mezuzah is provided for containing a small scroll inscribed with Biblical verses which protects the scroll in an aesthetically desirable manner while also allowing for easy access to the scroll for checking its condition and/or replacing the scroll. In accordance with one embodiment of the present invention, the mezuzah comprises a base member, which consists of an elongated mounting portion permanently mountable to a doorway fixture, and having a sealing portion at one end of the mounting portion. The mezuzah further has a housing member, which consists of a base engaging portion slidably engaged with the mounting portion, and an integral main body portion having a scroll receiving end with a bore therein for receiving and storing the scroll in the main body portion, with the main body portion being slidable along the mounting portion of the base member between a sealing position in which the scroll receiving end of the main body portion abuts the sealing portion of the base member to effectively seal the bore of the housing member for retaining the scroll therein, and a removal position in which the sealing portion is spaced sufficiently from the scroll receiving end of the main body portion to allow removal and insertion of the scroll from the bore.

BRIEF DESCRIPTION OF THE DRAWINGS

In the drawings, wherein like elements are referenced alike.

DETAILED DESCRIPTION OF THE PREFERRED EMBODIMENT(S)

Figure 1:
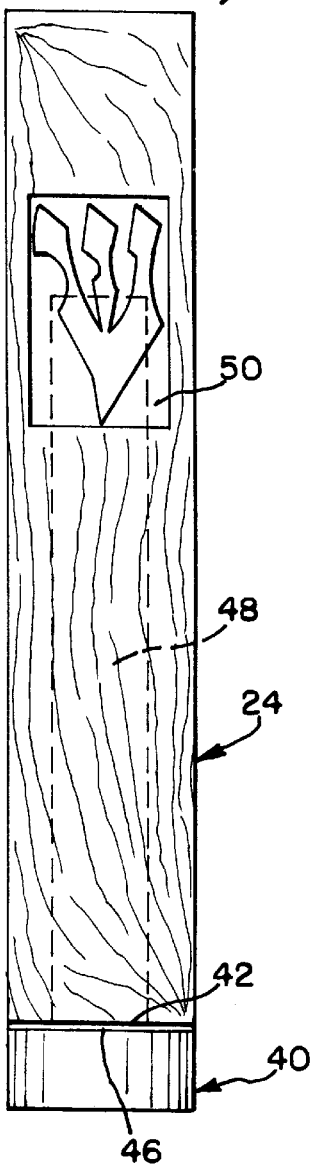
FIG. 1 is a front elevational view of a mezuzah embodying various features of the present invention.

A mezuzah embodying various features of the present invention is illustrated in FIGS. 1–11 and referred to generally by reference numeral 20. The mezuzah 20 has a base member referred to generally at 22, and a housing member referred to generally at 24.

Figure 6:
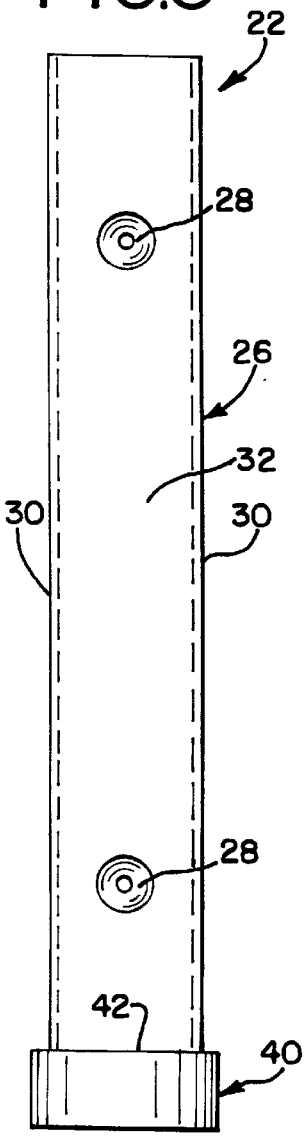
FIG. 6 is a front elevational view of the base member of the mezuzah of FIG. 1.
Figure 7:
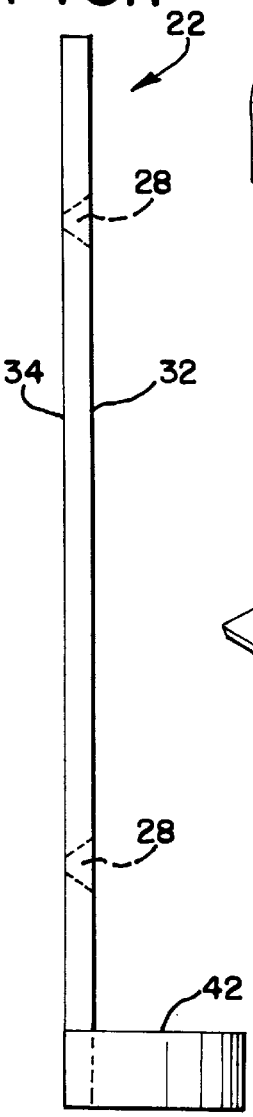
FIG. 7 is a side elevational view of the base member of the mezuzah of FIG. 1.

With reference to FIGS. 6 and 7, the base member 22 has an elongated mounting portion 26. A pair of longitudinally spaced chamfered screw holes 28 are provided in the mounting portion through which screws or other fasteners may be received for securely attaching the base member 22 to a doorway. The securing of the base member 22 may be permanent or semi-permanent, allowing for detachment in the event of moving from one home to another or the like.

Figure 4:
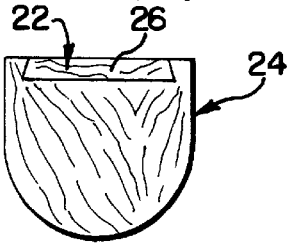
FIG. 4 is an elevational view of the upper end of the mezuzah of FIG. 1.
Figure 5:
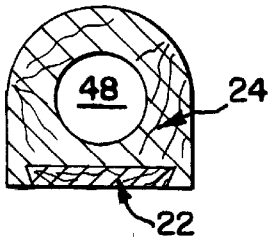
FIG. 5 is a sectional view taken along line 5—5 of FIG.2.
Figure 8:
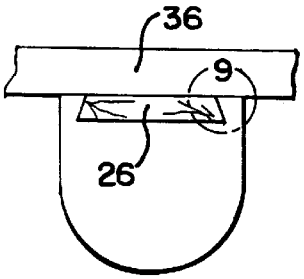
FIG. 8 is an elevational view of the upper end of the mezuzah of FIG. 1

The elongated mounting portion 26 of the base member 22 has opposite sides 30 which, as best seen in FIGS. 4 and 8, are dovetailed or angled inwardly from the front face 32 of the elongated mounting portion 26 toward its rear face 34. The rear face 34 of the elongated mounting portion 26 mounts flush against a doorway, such as the doorway 36 shown in FIG. 8. The chamfered screw holes 28 allow the base member 22 to be secured to the doorway 36 by flat head screws, whereby the screw heads are flush or recessed with respect to the front face 32 of the elongated mounting portion 26.

The base member 22 also has a sealing portion referred to generally by reference numeral 40 disposed at one end of the elongated mounting portion 26. The sealing portion 40 is generally D-shaped, and extends wider than the elongated mounting portion 26. The sealing portion 40 serves to limit the extent of movement of the housing member 24 and to effectively seal the opening in the housing in which the scroll is disposed, as described further below. In this regard, the sealing portion 40 has a sealing surface 42 which effectively seals the opening in the housing, as described below.

Figure 10:
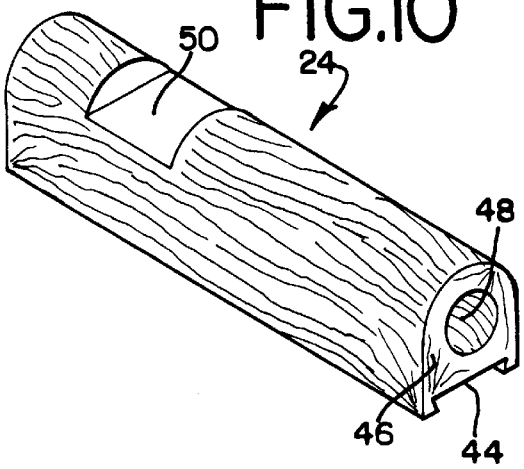
FIG. 10 is a perspective view of the housing member of the mezuzah of FIG. 1.
Figure 11:
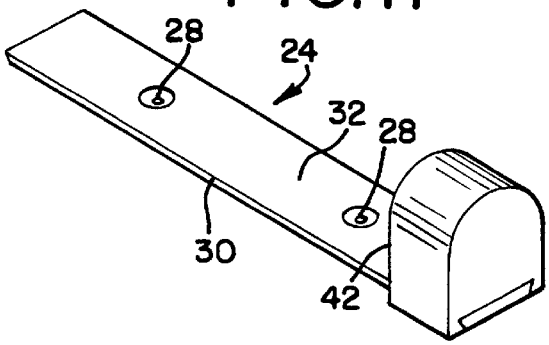
FIG. 11 is a perspective view of the base member of FIG. 1.

The illustrated mezuzah of the present invention also has a housing member 24 which is slidably engageable with the base member 22. As best illustrated in FIG. 10, the housing member 24 has a D-shape which corresponds in size and configuration to the D-shape of the sealing portion 40 of the base member 22. The rear face 42 of the housing member is generally flat and defines a dovetail channel 44 which is complementary with the dovetailed sides 30 of the elongated mounting portion 26 of the base member 22. Accordingly, the dovetailed elongated mounting portion 26 of the base member 22 is slidably received in the dovetail channel 44 of the housing member 24. Hence, after the base member 22 has been mounted to a doorway, the housing member 24 is slidable onto and off of the base member 22, with the dovetailed mounting portion 26 of the base member 22 sliding in and out of the dovetail channel 44 of the housing member 24.

The base member 22 and housing member 24 are preferably mounted to the doorway vertically, with the sealing portion 42 of the base member 22 disposed at the lower end or bottom of the elongated mounting portion 26. Accordingly, the housing portion 24 is slidably engageable by dovetail engagement downwardly onto the elongated mounting portion. The downward sliding of the housing member 24 relative to the stationarily mounted base member 22 is limited by abutment of the receiving end 46 of the housing member 24 against the sealing surface 42 on the upper side of the sealing portion 40 of the base member 22.

The housing member 24 has a bore 48 which extends inwardly into the housing member body from the sealing end 46 of the housing member. The bore is sized to slidably receive a scroll containing Biblical text.

Figure 2:
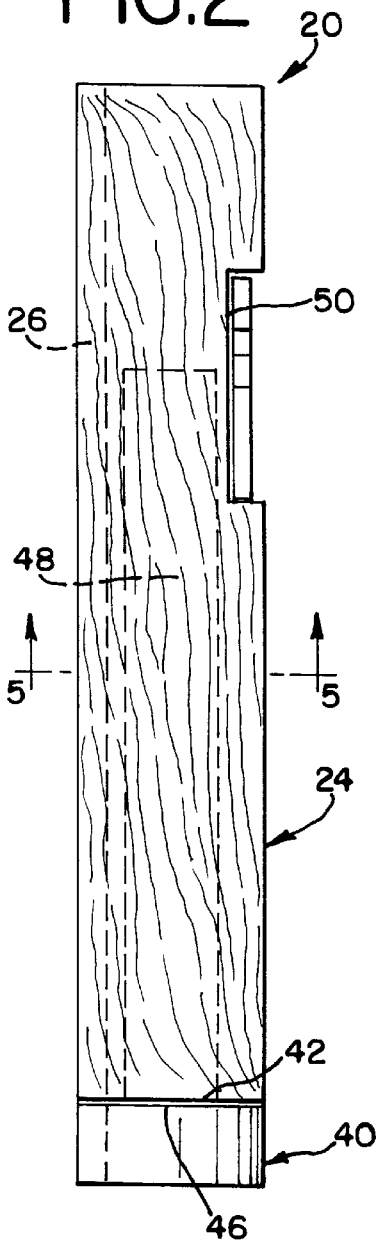
FIG. 2 is a side elevational view of the mezuzah of FIG. 1.
Figure 3:
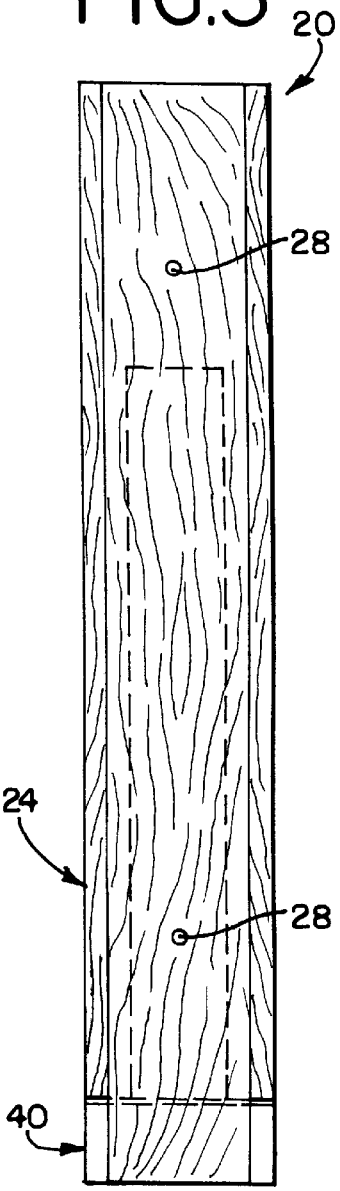
FIG. 3 is a rear elevational view of the mezuzah of FIG. 1.

In utilizing the mezuzah 20 of the present invention, the housing member 24 is detached from the base member 22, and a suitable Biblical scroll is slid into the bore 48 so that the scroll is disposed internally of the housing member 24. Separately, the base member 22 is mounted to a desired doorway fixture. The housing member 24 is then slid down onto the elongated mounting portion 26 of the base member 22 with the receiving end 46 of the housing member 24 extending downwardly. The housing member 24 is slid further downwardly until abutment of the receiving end 46 of the housing member 24 against the sealing surface 42 or upper end of the sealing portion 40 of the base member 22. This position is shown in FIGS. 1 and 2. The sealing surface 42 of the sealing portion 40 of the base member 22 then blocks the bore 48 of the housing member 24 to effectively seal the scroll inside the bore inside the housing member 24 to protect the scroll. The tolerance of the dovetail joint may be made such that the housing member 24 may slide unassisted, by the force of gravity downwardly into abutment with the sealing portion 40 of the base member 22. The mezuzah 20, with a scroll safely disposed therein, is thereby maintained in a doorway, in accordance with Judaic teachings.

On occasion, when it is desired to check the integrity of the scroll which is disposed in the mezuzah, or to change to a new scroll, the housing member 24 may be slid upwardly until it disengages from the elongated mounting portion 26 of the base member 22. Easy access to the scroll disposed in the bore 48 of the housing member 24 is then realized, to allow for checking the condition of the scroll and/or replacement of the scroll. The housing portion 24 is then easily slid back onto the elongated mounting portion 26 of the base member 22, and slid downwardly until abutment of the receiving end 46 of the housing member 24 against the sealing surface 42 of the sealing portion 40 of the base member 22.

Figure 9:
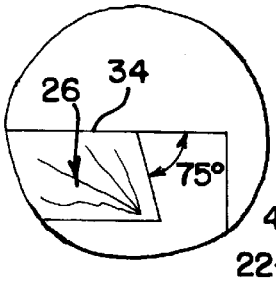
FIG. 9 is an enlarged partial view of the circular area depicted in FIG. 8.

As seen in FIGS. 8 and 9, the dovetails of the elongated mounting member 26 and housing member 24 are preferably complementary with one another and extend at an angle of approximately 75 degrees. In accordance with another aspect of the present invention, a recessed flat 50 may be formed in the rounded face of the housing member 24, which recessed flat 50 preferably extends parallel to the front and rear faces 32 and 34 of the base member 22, so that the recessed flat 50 extend parallel to the doorway fixture to which the mezuzah 20 is mounted. The recessed flat 50 may bear an indicia such as a letter of the Jewish alphabet, as illustrated in FIGS. 1 and 2.

Figure 12:
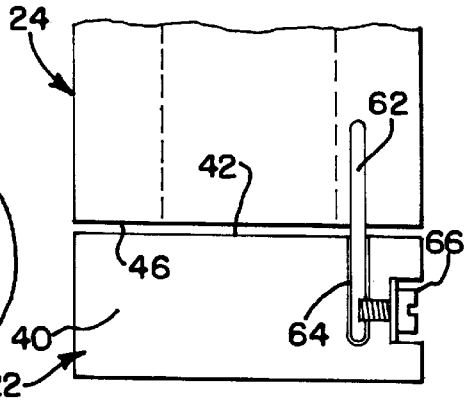
FIG. 12 is an enlarged schematic view of a latch embodying various features of an alternative embodiment of the present invention, and suitable for maintaining selective engagement between the base member and the housing member.

With reference now to FIG. 12, in accordance with another aspect of the present invention a latch mechanism, such as the latch mechanism 60, may be provided for securing the receiving end 46 of the housing member 24 adjacent the sealing surface 42 of the base member 22, and preventing sliding disengagement of the housing member 24 from the base member 22. Such a latch may be an effective deterrent to theft or desecration of the scroll disposed in the mezuzah. An embodiment of a suitable latch 60 is illustrated in FIG. 12. A narrow tab 62 extends downwardly beyond the receiving end 46 of the housing member 24, which tab 62 is received in a complementary narrow slot 64 which is formed in the sealing surface 42 of the base member 22. A fastener 66, such as a screw, disposed in the sealing portion 40 of the base member 22 is selectively engageable and disengageable with the portion of the tab 62 which extends into the slot 64, to allow selective allowance and prevention of disengagement of the housing member 24 from the base member 22. Manifestly, the latch mechanism is not limited to the specific embodiment disclosed, and either of the base member 22 or housing member 24 may have a latch selectively engageable with the other of the base member and housing member in any manner to selectively maintain non-slidable engagement between the base and housing members.

The invention having been described by way of illustrated and preferred embodiment, many variations and modifications will be readily apparent to those skilled in the art. Hence, the invention is not limited to the specific embodiments disclosed herein for illustrative purposes, but rather is defined by the accompanying claims.

What is claimed is:

1. A mezuzah for containing a small scroll inscribed with Biblical verses, the mezuzah comprising:

a base member, comprising:

an elongated mounting portion permanently mountable to a doorway fixture; and a sealing portion disposed at one end of the mounting portion; and a housing member, comprising:

a base engaging portion slidably engaged with the mounting portion; and an integral main body portion having a scroll receiving end with a bore therein for receiving and storing the scroll in the main body portion, the main body portion being slidable along the mounting portion of the base member between a sealing position in which the scroll receiving end of the main body portion abuts the sealing portion of the base member to effectively seal the bore of the housing member for retaining the scroll therein, and a removal position in which the sealing portion is spaced sufficiently from the scroll receiving end of the main body portion to allow removal and insertion of the scroll from the bore, wherein one of said base member and said housing member has a latch selectively engageable with the other of said base member and housing member to selectively maintain engagement between said base and housing members.

2. A mezuzah for containing a small scroll inscribed with Biblical verses, the mezuzah comprising:

a base member, comprising:

an elongated mounting portion permanently mountable to a doorway fixture; and a sealing portion disposed at one end of the mounting portion; and a housing member, comprising:

a base engaging portion slidably engaged with the mounting portion; and an integral main body portion having a scroll receiving end with a bore therein for receiving and storing the scroll in the main body portion, the main body portion being slidable along the mounting portion of the base member between a sealing position in which the scroll receiving end of the main body portion abuts the sealing portion of the base member to effectively seal the bore of the housing member for retaining the scroll therein, and a removal position in which the sealing portion is spaced sufficiently from the scroll receiving end of the main body portion to allow removal and insertion of the scroll from the bore, wherein the elongated mounting portion has a plurality of apertures for receiving fasteners for permanently mounting the mounting portion to the doorway fixture.

3. A mezuzah for containing a small scroll inscribed with Biblical verses, the mezuzah comprising:

a base member, comprising:

an elongated mounting portion permanently mountable to a doorway fixture; and a sealing portion disposed at one end of the mounting portion; and a housing member, comprising:

a base engaging portion slidably engaged with the mounting portion; and an integral main body portion having a scroll receiving end with a bore therein for receiving and storing the scroll in the main body portion, the main body portion being slidable along the mounting portion of the base member between a sealing position in which the scroll receiving end of the main body portion abuts the sealing portion of the base member to effectively seal the bore of the housing member for retaining the scroll therein, and a removal position in which the sealing portion is spaced sufficiently from the scroll receiving end of the main body portion to allow removal and insertion of the scroll from the bore, wherein the base engaging portion and mounting portion are engaged by complementary dovetail configurations.

4. A mezuzah in accordance with any one of claims 1–3 in which the elongated mounting portion of the base member is mountable to extend vertically on the doorway fixture, with the sealing portion disposed at the lower end of the mounting portion.

5. A mezuzah in accordance with any one of claims 1–3 in which the main body portion of the housing member is mountable to extend vertically when engaged with the base member, with the scroll receiving end of the housing member being disposed at the bottom of the housing member.

6. A mezuzah in accordance with any one of claims 1–3 in which the main body potion is substantially D-shaped.

7. A mezuzah in accordance with claim 6 in which the sealing portion of the base member has substantially the same shape as the shape of the main body portion.

8. A mezuzah in accordance with any one of claims 1–3 in which the scroll receiving end of the housing member may be disposed downwardly such that the scroll may fall out from the bore under its own weight upon movement of the main body portion to said removal position.

9. A mezuzah for containing a small scroll inscribed with Biblical verses, the mezuzah comprising:

a base member, comprising:

an elongated mounting portion of generally flat, plate-like configuration having front and rear faces and opposed side edges; and a sealing portion disposed at one end of the mounting portion and projecting laterally from the front face thereof; and a housing member, comprising:

a base engaging portion slidably engageable with the side edges of the mounting portion; and an integral main body portion having a scroll receiving end with a bore therein for receiving and storing the scroll in the main body portion, the main body portion being slidable along the mounting portion of the base member between a sealing position in which the scroll receiving end of the main body portion abuts the sealing portion of the base member to effectively seal the bore of the housing member for retaining the scroll therein, and a removal position in which the sealing portion is spaced sufficiently from the scroll receiving end of the main body portion to allow removal and insertion of the scroll from the bore.

10. A mezuzah in accordance with claim 9 in which one of said base member and said housing member has a latch selectively engageable with the other of said base member and housing member to selectively maintain engagement between said base and housing members.

11. A mezuzah in accordance with claim 9 in which the elongated mounting portion has a plurality of apertures for receiving fasteners for permanently mounting the mounting portion to the doorway fixture.

12. A mezuzah in accordance with claim 9 in which the base engaging portion and the side edges of the mounting portion are engaged by complementary dovetail configurations.

13. A mezuzah in accordance with claim 9 in which the elongated mounting portion of the base member is mountable to extend vertically on the doorway fixture, with the sealing portion disposed at the lower end of the mounting portion.

14. A mezuzah in accordance with claim 13 in which the main body portion of the housing member is mountable to extend vertically when engaged with the base member, with the scroll receiving end of the housing member being disposed at the bottom of the housing member.

15. A mezuzah in accordance with claim 9 in which the main body portion is substantially D-shaped.

16. A mezuzah in accordance with claim 15 in which the sealing portion of the base member has substantially the same shape as the shape of the main body portion.

17. A mezuzah in accordance with claim 9 in which the scroll receiving end of the housing member may be disposed downwardly to such that the scroll may fall out from the bore under its own weight upon movement of the main body portion to said removal position.

* * * * *